US005519313A

United States Patent [19]

Wong et al.

[11] Patent Number: 5,519,313

[45] Date of Patent: May 21, 1996

[54] TEMPERATURE-COMPENSATED VOLTAGE REGULATOR

[75] Inventors: Stephen L. Wong, Scarsdale; Sreeraman Venkitasubrahmanian, Ossining, both of N.Y.

[73] Assignee: North American Philips Corporation, New York, N.Y.

[21] Appl. No.: 43,418

[22] Filed: Apr. 6, 1993

[51] Int. Cl.[6] ..... G05F 3/16; G05F 3/20

[52] U.S. Cl. ..... 323/315; 323/907

[58] Field of Search ..... 323/281, 282, 323/312, 313, 314, 315, 317, 907; 307/296.1, 296.6, 296.7, 296.8; 330/288; 327/530, 534, 535, 538, 539, 540

[56] References Cited

U.S. PATENT DOCUMENTS

| | | | |
|---|---|---|---|
| 3,916,508 | 11/1975 | Conzelmann et al. | 323/313 |
| 4,030,023 | 6/1977 | Keith | 323/907 |
| 4,686,451 | 8/1987 | Li et al. | 323/313 |
| 4,774,452 | 9/1988 | Ahmed | 323/314 |
| 4,792,749 | 12/1988 | Kitagawa et al. | 323/314 |
| 4,890,052 | 12/1989 | Hellums | 323/315 |
| 5,023,543 | 6/1991 | Tse | 323/314 |
| 5,084,665 | 1/1992 | Dixon et al. | 323/907 |
| 5,173,656 | 12/1992 | Seevinck et al. | 323/907 |
| 5,334,929 | 8/1994 | Schade | 323/315 |
| 5,352,973 | 10/1994 | Audy | 323/907 |
| 5,402,061 | 3/1995 | Marsh et al. | 323/315 |
| 5,430,367 | 7/1995 | Whitlock et al. | 323/907 |

FOREIGN PATENT DOCUMENTS

| | | | |
|---|---|---|---|
| 0183185 | 2/1989 | European Pat. Off. | G05F 3/28 |
| 2237559 | 10/1974 | Germany . | |
| 2146808 | 4/1985 | United Kingdom | G05F 3/18 |

*Primary Examiner*—Matthew V. Nguyen
*Attorney, Agent, or Firm*—Steven R. Biren

[57] ABSTRACT

A temperature-compensated voltage regulator includes a field effect transistor voltage buffer which receives a high-voltage input and provides a low-voltage output, and a voltage generator having a series connection of a zener diode and at least one p-n junction diode for generating a reference voltage. The voltage generator is coupled between the low-voltage output of the voltage buffer and the input of a current mirror, with the output of the current mirror being coupled to the gate electrode of the field effect transistor in the voltage buffer. Additionally, the output of the current mirror is coupled to the low-voltage output of the voltage buffer by a resistor. The resulting voltage regulator circuit features high performance in a simple, economical configuration.

6 Claims, 1 Drawing Sheet

TEMPERATURE-COMPENSATED VOLTAGE REGULATOR

BACKGROUND OF THE INVENTION

The invention is in the field of voltage regulators, and relates more particularly to a temperature-compensated voltage regulator capable of producing a low-voltage output from a high-voltage input.

Voltage regulator circuits are presently used to provide regulated power supply voltage in a wide variety of circuits and in various integrated circuit applications. Several different voltage regulator circuits are shown in U.S. Pat. Nos. 5,023,543 and 4,792,749, and in European Patent Specification No. 0 183 185. However, the prior-art regulator circuits suffer from a number of drawbacks, such as the inability to operate with extremely high input voltages, undue circuit complexity and expense, the inability to provide self-biasing and self-starting, instability, high power consumption, and the use of components which are difficult or costly to integrate.

Accordingly, it would be desirable to have a voltage regulator which can operate with extremely high voltage inputs, which is simple and inexpensive to manufacture, and which provides high performance in a simple and compact circuit configuration.

SUMMARY OF THE INVENTION

It is thus an object of the invention to provide a temperature-compensated voltage regulator which is capable of providing a low-voltage output from a very high voltage input.

It is a further object of the invention to provide a voltage regulator having high performance, low power consumption, self-starting and self-biasing capability in a stable, compact and economical configuration.

In accordance with the invention, these objects are achieved by a new temperature-compensated voltage regulator which includes a voltage buffer for receiving a high-voltage input (up to 500 volts) and providing a low-voltage output, and a voltage generator for generating a reference voltage coupled between the low-voltage output of the voltage buffer and an input of a current mirror, with the output of the current mirror being coupled to a control input of the buffer and, through a resistor, to the low-voltage output of the voltage buffer.

In a preferred embodiment of the invention, the voltage buffer is a field effect transistor, such as a JFET or a depletion-mode MOS FET, and the voltage generator is formed by a series connection of a zener diode and at least one p-n junction diode. The current mirror, which couples the voltage generator to the control input of the field effect transistor and to the resistor, is composed of a diode-connected transistor having its control electrode coupled to the voltage generator and also to the control electrode of a second transistor, whose output is coupled to the resistor and the control input of the voltage buffer.

In a further preferred embodiment of the invention, the series connection of the zener diode and the at least one junction diode serves not only as the voltage generator, but also as a temperature compensation mechanism by configuring the circuit such that the net temperature coefficient of the series connection of diodes (including the diode-connected current-mirror transistor) is substantially zero.

BRIEF DESCRIPTION OF THE DRAWING

The invention may be more completely understood with reference to the following detailed description, to be read in conjunction with the accompanying drawing, in which.

DESCRIPTION OF THE PREFERRED EMBODIMENTS

Figure 1:
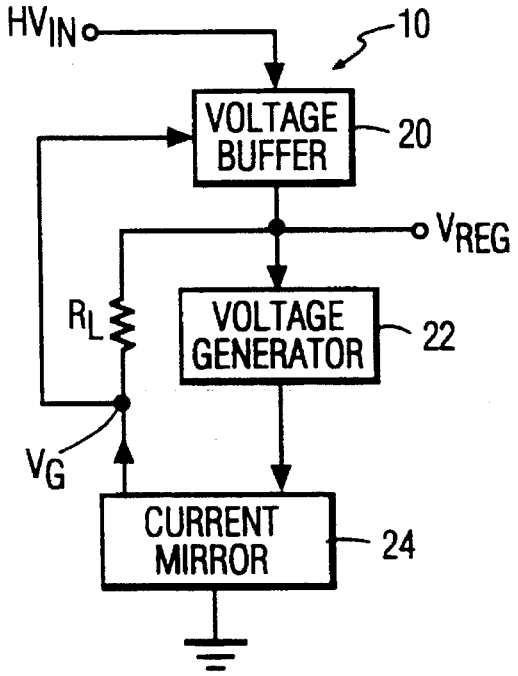
FIG. 1 shows a partly-schematic and partly-block diagram of a temperature-compensated voltage regulator in accordance with the invention.

A temperature-compensated voltage regulator 10 is shown in partly-schematic and partly-block diagram form in FIG. 1. The voltage regulator 10 includes a voltage buffer 20 having a high-voltage input $HV_{IN}$, a control input $V_G$ and a low-voltage output $V_{REG}$. A voltage generator 22 for generating a reference voltage is coupled between the low-voltage output of the voltage buffer and an input of a current mirror 24. The current mirror also has a common terminal, typically ground, and an output which is coupled to the control input $V_G$ of the voltage buffer 20. The configuration of FIG. 1 is completed by a resistor $R_L$ which couples the output of the current mirror 24 to the low-voltage output $V_{REG}$, with the regulated output voltage being generated between the low-voltage output $V_{REG}$ of the voltage buffer and the common (ground) terminal.

Figure 2:
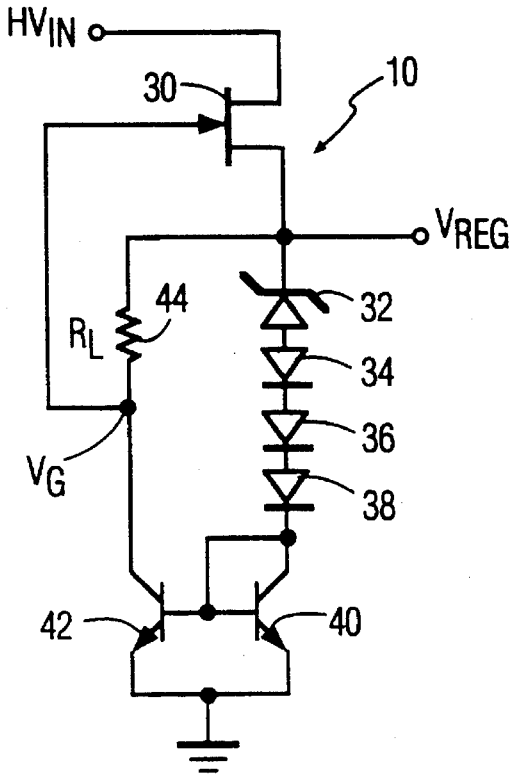
FIG. 2 shows a schematic diagram of a temperature-compensated voltage regulator in accordance with the invention.

A preferred embodiment of the voltage regulator is shown in schematic form in FIG. 2. In FIG. 2, the voltage buffer of the voltage regulator 10 is formed by a junction field effect transistor (JFET) 30 having its main current path connected between the high-voltage input $HV_{IN}$ and the low-voltage output $V_{REG}$. The voltage generator includes a series connection of a zener diode 32 and at least one (here three) p-n junction diodes 34, 36 and 38. Diode 38 is coupled to the current mirror by being connected to the collector and base of diode-connected transistor 40, whose emitter is connected to ground, and the output of the current mirror, at the collector of a transistor 42, is connected to the gate of buffer transistor 30 ($V_G$). The base of transistor 42 is connected to the base of transistor 40, and the emitter of transmitter 42 is connected to ground. The circuit configuration is completed by coupling the collector of transistor 42 and the gate of transistor 30 ($V_G$) through load resistor 44 ($R_L$) to the low-voltage output $V_{REG}$. Although the value of resistor $R_L$ is not critical, it will typically will have a high resistance value, such as 100K ohms, in order to minimize power consumption.

The magnitude of the regulated output voltage $V_{REG}$ is determined by appropriate selection of the zener voltage of zener diode 32, and by selection of the number of series-connected diodes coupled between zener diode 32 and transistor 40. In a preferred embodiment, zener diode 32 has a zener voltage of 9.5 volts, and three p-n diodes (34, 36 and 38) are connected between the zener diode and diode-connected transistor 40. Thus, in this embodiment, the regulated output voltage $V_{REG}$ will be equal to 9.5 volts plus a total of four forward voltage drops of about 0.7 volts each (i.e., the voltage drops across p-n diodes 34, 36 and 38, plus the voltage drop across diode-connected transistor 40) for a total regulated output voltage of about 12.3 volts. Furthermore, in this embodiment, the temperature coefficient of the zener diode is about +8 mV/°C., while each p-n junction diode has a temperature coefficient of about −2 mV/°C. The effective temperature coefficient of the three p-n diodes plus the diode-connected transistor is therefore about −8 mV/°C. thus to a first order essentially balancing the +8 mV/°C. temperature coeffecient of the zener diode and providing a net temperature coefficient of zero. Clearly, other combinations of zener diode voltage, temperature coefficients, and numbers of p-n junction diodes can be employed, consistent with the goals of providing a desired output voltage in combination with a zero first-order temperature coefficient.

In operation, a high voltage input (up to about 500 volts depending upon the design of buffer transistor 30) is applied to the high-voltage input $HV_{IN}$. Transistor 30 will then conduct, causing current to flow to ground through the series-connected diodes 32, 34, 36 and 38, and diode-connected transistor 40 of the current mirror. The voltage drops across these components will establish an output voltage at the low-voltage output $V_{REG}$ of about 12 volts with respect to ground. Additionally, the current flowing into transistor 40 will be reflected by the current mirror to cause a proportional current flow through resistor 44 and transistor 42. This current flow through resistor 44 will establish a gate voltage $V_G$ at the gate of buffer transistor 30 which is equal to the regulated output voltage less the voltage drop caused by the current flowing through resistor 44. Should the regulated output voltage $V_{REG}$ tend to rise above its nominal value, the current through the series-connected diodes and into the current mirror will increase, causing the reflected current in resistor 44 to likewise increase. This in turn will cause a greater voltage drop across resistor 44, thus lowering the gate voltage $V_G$ which is provided to buffer transistor 30. Transistor 30 will then become less conductive, resulting in a decrease in the regulated output voltage back towards the nominal value. Similarly, if the output voltage drops below the nominal regulated value, current through the series-connected diodes and into the current mirror will decrease, causing a commensurate decrease in the mirrored current through resistor 44 and resulting in an increase in the gate voltage to transistor 30 and an increase in the output voltage back up towards the nominal regulated value, thus providing effective voltage regulation.

Despite its simplicity, the circuit shown in FIG. 2 offers several important advantages over more complex prior-art circuits. The circuit is both self-starting and self-biasing, thus providing reliable performance, and is capable of handling input voltages as high as 500 volts with appropriate selection of buffer transistor 30. Furthermore, despite its simplicity the disclosed circuit is capable of providing a desired regulated output voltage along with good temperature compensation. Additionally, the circuit features low power consumption and, due to its simplicity, offers the additional advantages of stability, compactness and economy, and can be easily fabricated using conventional integrated circuit technology.

While the invention has been particularly shown and described with reference to a preferred embodiment thereof, it will be understood by those skilled in the art that various changes in form and detail may be made without departing from the spirit and scope of the invention. Thus, for example, buffer transistor 30 may be a depletion-mode MOSFET rather than a JFET, and MOS transistors, rather than bipolar transistors, may be used for transistors 40 and 42 of the current mirror. Finally, as noted above, various types and numbers of series-connected diodes may be used in order to achieve a desired regulated output voltage and desired temperature compensation characteristics.

What is claimed is:

1. A temperature-compensated voltage regulator, which comprises:

voltage buffer means having a high-voltage input, a control input and a low-voltage output;

voltage generator means for generating a reference voltage and having a first terminal coupled to the low-voltage output of said voltage buffer means and a second terminal, said voltage generator means comprising a series connection of a zener diode and at least one p-n junction diode;

current mirror means having an input coupled to said second terminal, an output coupled to the control input of said voltage buffer means, and a common terminal; and resistive means for coupling said current mirror output to the low-voltage output of said voltage buffer means, a temperature-compensated, regulated output voltage being generated during operation between said first terminal and said common terminal.

2. A temperature-compensated voltage regulator as in claim 1, wherein said voltage buffer means comprises a field effect transistor having a main current path coupled between said high-voltage input and said low-voltage output and a gate electrode coupled to said control input.

3. A temperature-compensated voltage regulator as in claim 2, wherein said field effect transistor comprises a JFET.

4. A temperature-compensated voltage regulator as in claim 2, wherein said field effect transistor comprises a depletion-mode MOS FET.

5. A temperature-compensated voltage regulator as in claim 1, wherein said current mirror means comprises a first diode-connected transistor having a control electrode and a main current path coupled between said second terminal and said common terminal, and a second transistor having a control electrode and a main current path coupled between the control input of said voltage buffer means and said common terminal, said control electrodes being coupled together.

6. A temperature-compensated voltage regulator as in claim 5, wherein the number of p-n junction diodes is selected such that the sum of the voltage drops of said zener diode, said at least one p-n junction diode and said first diode-connected transistor substantially equals said regulated output voltage, and wherein the temperature coefficient of said zener diode substantially equals, but is of opposite sign to, the sum of the temperature coefficients of said number of p-n junction diodes and said first diode-connected transistor.

* * * * *